US007177435B2

(12) United States Patent
Uchida et al.

(10) Patent No.: US 7,177,435 B2
(45) Date of Patent: Feb. 13, 2007

(54) LIVING ORGANISM CONDUCTIVE ACTUATOR

(75) Inventors: Koji Uchida, Sendai (JP); Masaaki Fukumoto, Yokohama (JP); Toshiaki Sugimura, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 653 days.

(21) Appl. No.: 09/969,952

(22) Filed: Oct. 2, 2001

(65) Prior Publication Data

US 2002/0046619 A1 Apr. 25, 2002

(30) Foreign Application Priority Data

Oct. 2, 2000 (JP) ..... 2000-302736

(51) Int. Cl.
*H04R 25/00* (2006.01)

(52) U.S. Cl. ..... 381/326; 381/151

(58) Field of Classification Search ..... 381/326, 381/151, 380, 396; 455/95, 100; 340/5.1, 340/333

See application file for complete search history.

(56) References Cited

U.S. PATENT DOCUMENTS 5,456,654 A * 10/1995 Ball ..... 381/326
5,574,794 A * 11/1996 Valley ..... 381/361
6,141,427 A * 10/2000 Fukuda ..... 381/151
6,754,472 B1 * 6/2004 Williams et al. ..... 455/100
6,861,944 B1 * 3/2005 Hoepelman ..... 340/5.1

* cited by examiner

*Primary Examiner*—Suhan Ni
(74) *Attorney, Agent, or Firm*—Frishauf, Holtz, Goodman & Chick, P.C.

(57) ABSTRACT

The invention provides an optimal structure able to reduce sound leakage and improve transmission characteristics and control a vibration transmitting path of internal and external portions in a living organism conductive actuator. Therefore, the living organism conductive actuator has a communication signal transmitting portion for transmitting a communication signal in contact with an operator's wrist, hand, hand rear portion, finger, or nail tip, and a voice input portion.

4 Claims, 8 Drawing Sheets

LIVING ORGANISM CONDUCTIVE ACTUATOR

BACKGROUND OF THE INVENTION (1) Field of the Invention

The present invention relates to a living organism conductive actuator constructed by a portion for transmitting a communication signal, such as an audio signal, to a living organism as a vibrating medium and a voice input portion, and more particularly, relates to the living organism conductive actuator used in an input and an output for transmitting and receiving a calling signal of a portable telephone, etc., and the communication signal, such as an audio signal.

(2) Background Art

A living organism conductive actuator is conventionally known as a device used to receive a calling signal of a portable telephone, etc., and transmit and receive a communication signal. The living organism conductive actuator is integrally constructed by a structure in which a communication signal transmitting portion for transmitting the received communication signal, such as an audio signal, and a voice input portion are overlapped in an axial direction. The communication signal transmitting portion transmits the received communication signal, such as an audio signal, to the interior of an external cover through which two wires for support extend.

In the conventional living organism conductive actuator, the structure for overlapping the communication signal transmitting portion and the voice input portion having an external surface formed by rubber in the axial direction, i.e., a longitudinal structure has an influence of a reduction in sound leakage, vibrational transmission, noises of a voice input and an external mechanical load on internal constructional parts.

SUMMARY OF THE INVENTION

It is an object of the present invention to provide a living organism conductive actuator having an optimal structure able to reduce noise propagation (hereinafter called sound leakage) due to a medium on an external surface and improve transmission characteristics and control a vibration transmitting path of internal and external portions.

According to the present invention, there is provided a living organism conductive actuator which is constructed by a portion (communication signal transmitting portion) for transmitting a communication signal in contact with an operator's wrist, hand, hand rear portion, finger, or nail tip, and a voice input portion. A corner portion of an external cover is chamfered and the weight of a main body of the external cover is set to several grams, and the external cover is manufactured by a metal. Further, a gap not interfered with a structural living organism on a side of the voice input portion is formed. A supporting portion of this main body is constructed by two wires having a spring property and a viscoelastomer arranged in an outer circumference of this supporting portion.

Further, in the invention, the communication signal transmitting portion is a two-resonance system and is set to a structure in which a spring of a first vibration system is set to a spiral body and a spiral arm is extended in a direction perpendicular to a face of this spiral body. A second vibration system uses a material having a large Poisson ratio in a joining portion. A material having a vibrationproof effect is used in a living organism contact portion except for the communication signal transmitting portion. The voice input portion is arranged from an upper portion of the communication signal transmitting portion to its side face, and a vibrationproof material is added to the exterior. An elastic adhesive is used in the upper portion of the communication signal transmitting portion and a joining portion of constructional parts in the vicinity of the voice input portion.

Namely, in accordance with the invention, it is possible to obtain a living organism conductive actuator characterized in that the living organism conductive actuator comprises a communication signal transmitting portion for transmitting a communication signal in contact with an operator's wrist, hand, hand rear portion, finger, or nail tip, and a voice input portion.

Further, the living organism conductive actuator of the invention preferably comprises two wires for supporting the living organism conductive actuator by an external portion and having a spring property.

Further, in the living organism conductive actuator of the invention, a viscoelastomer is preferably arranged in supporting portions of the two wires having the spring property such that no additional resonance is generated.

Further, in one of the above constructions of the living organism conductive actuator, a living organism transmitting face of the communication signal transmitting portion is preferably constructed of a shaped resin so as to reduce friction in a shearing direction.

Further, in the living organism conductive actuator of the invention, a noninterference gap is preferably formed in a structure of the voice input portion to avoid a mechanical interference except for a transmitted living organism.

Further, in the living organism conductive actuator of the invention, the voice input portion is preferably arranged on a side face of the communication signal transmitting portion from its upper portion so as to reduce a voice input noise.

Further, in the living organism conductive actuator of the invention, a vibrationproof material is preferably added to the exterior of the voice input portion to reduce a voice input noise from the communication signal transmitting portion.

Further, in the living organism conductive actuator of the invention, a structure for improving damping of a vibration returned from a living organism and a close contact property with the living organism is preferably formed by using a material having a vibrationproof effect in a living organism contact portion except for the communication signal transmitting portion.

Further, the living organism conductive actuator of the invention preferably comprises an external cover manufactured by a metal and storing the communication signal transmitting portion, and a noise due to a mechanical load of the communication signal transmitting portion is preferably restrained by this external cover manufactured by the metal.

Further, in the living organism conductive actuator of the invention, the weight of a main body of the living organism conductive actuator is preferably set to several ten grams to reduce noise propagation due to a medium on an external surface.

Further, in the living organism conductive actuator of the invention, a structure for chamfering a corner portion of an external cover to reduce an effective area of vibration transmission is preferably formed to reduce noise propagation due to a medium on a surface.

Further, in the living organism conductive actuator of the invention, a vibration system of the communication signal transmitting portion is preferably set to a two-resonance structure to reduce noise propagation due to a medium on an external surface. Here, in this living organism conductive actuator, a material having a large Poisson ratio is more preferably formed in a joining portion of the two-resonance system structure in the communication signal transmitting portion so that vibrational energy in a vibration transmitting direction is dispersed in a vertical direction, and the vibrational energy can be more preferably relaxed in a second mode of a first vibration system constructed by a spiral spring and a magnetic circuit constructed by a yoke, a magnet and a plate as a mass.

Further, in the living organism conductive actuator of the invention, a vibration system is preferably made by one end of the communication signal transmitting portion and constructional parts in the vicinity of the voice input portion, and a structure for dispersing vibrational directivity and using elastic adhesion in a joining portion is preferably formed so as not to generate a vibration noise.

Further, in the living organism conductive actuator of the invention, vibration transmission is preferably improved by adopting a structure in which a spring of a first vibration system of the communication signal transmitting portion is set to a spiral body and a spiral arm is extended in a direction perpendicular to a face of the spiral body.

Further, in the living organism conductive actuator of the invention, a mechanical load with respect to an internal circuit is preferably restrained by manufacturing an external cover covering the voice input portion and the communication signal transmitting portion by a metal.

DESCRIPTION OF THE PREFERRED EMBODIMENT

Figure 1A:
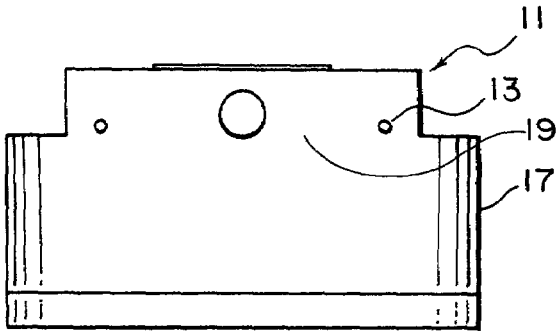
FIG. 1A PRIOR ART
FIG. 1A is a front view showing a living organism conductive actuator of a longitudinal structure in the prior art.
Figure 1B:
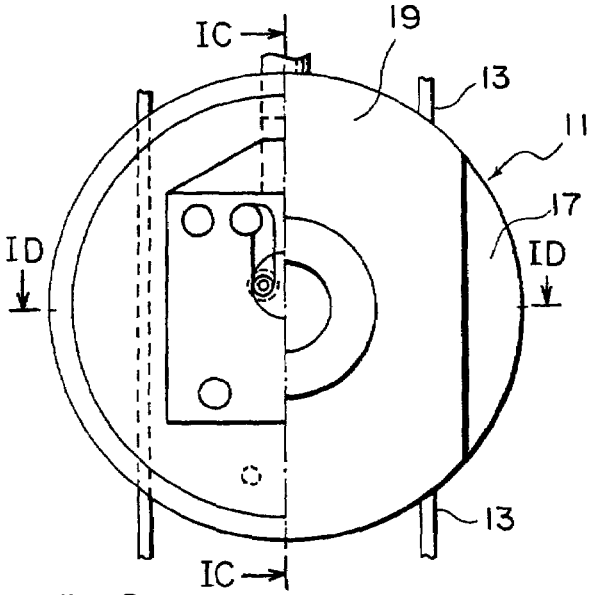
FIG. 1B PRIOR ART
FIG. 1B is a plan semi-sectional view of an actuator of FIG. 1A.
Figure 1C:
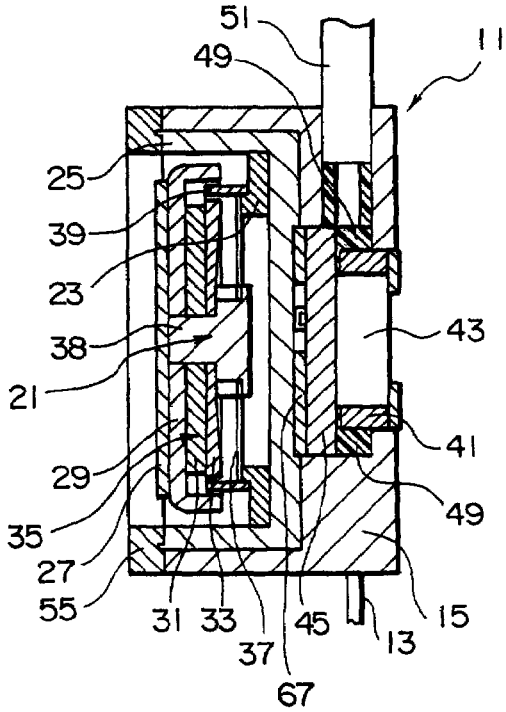
FIG. 1C PRIOR ART
FIG. 1C is a cross-sectional view taken along line 1C—1C of FIG. 1A.
Figure 1D:
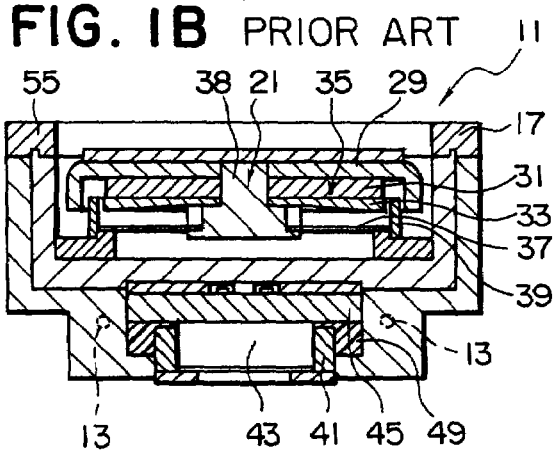
FIG. 1D PRIOR ART
FIG. 1D is a cross-sectional view taken along line 1D—1D of FIG. 1A.

A living organism conductive actuator in the prior art will be explained with reference to the drawings to easily understand the invention prior to the description of an embodiment of the invention.

Referring to FIGS. 1A to 1D, according to the prior art a living organism conductive actuator 11 is integrally constructed by a structure in which a communication signal transmitting portion 17 and a voice input portion 19 are overlapped with each other in an axial direction. The communication signal transmitting portion 17 transmits a received communication signal, such as an audio signal, to the interior of an external cover 15 through which two wires 13 for support extend. In the communication signal transmitting portion 17, a living organism contact signal transmitting portion 21 opened to one end portion of the external cover 15 and a base 23 for supporting the living organism contact signal transmitting portion 21 are arranged within a living organism contact vibration transmitting portion cover 25. In the living organism contact signal transmitting portion 21, a magnetic circuit 35 constructed by overlapping a yoke 29 of a cup shape, a permanent magnet 31 and a fixed member 33 is overlapped with a shaped resin plate 27, which is formed of a shaped resin. Further, a spiral spring 37 is overlapped with the magnetic circuit 35 and a fixed member 38 extends through the magnetic circuit 35 so that the plate 27, the magnetic circuit 35 and the fixed member 38 are integrally formed. The spiral spring 37 is fixed to the living organism contact vibration transmitting portion cover 25 through the base 23. A coil 39 is mounted between the magnetic circuit 35 and the base 23.

The voice input portion 19 has a vibrationproof material 41 arranged so as to be exposed on the other end face side of the external cover 15, a microphone 43 inserted into the vibrationproof material 41, and a substrate 45 stuck to the other face of the microphone 43 through an elastic adhesive 49. An internal circuit 67 is arranged on a face of the substrate 45 on a side opposed to the microphone 43. The internal circuit 67 is mounted to an outside face of the living organism contact vibration transmitting portion cover 25.

The embodiment of the invention will next be explained with reference to the drawings. In the explanation of the present invention, similar parts are described by using similar reference numerals.

Referring to FIGS. 2A to 2D, a living organism conductive actuator 57 is constructed by a communication signal transmitting portion 59 for transmitting a received voice signal and a received calling signal by contact, and a voice input portion 61.

The communication signal transmitting portion 59 has a living organism contact vibration transmitting portion 21 and an internal circuit 67 arranged on the outside face of a living organism vibration contact portion cover 25 covering the living organism contact vibration transmitting portion 21. The living organism contact vibration transmitting portion 21 and the internal circuit 67 are covered with the external cover 15.

The living organism contact vibration transmitting portion 21 includes the magnetic circuit 35 arranged on one face of the plate 27, which is formed of a shaped resin, the spiral spring 37 for supporting the magnetic circuit 35, and the base 23 for supporting the spiral spring 37. The coil 39 is inserted between the base 23 arranged around the spiral spring 37 and the magnetic circuit 35. The base 23 is supported on an inside face of the living organism contact vibration transmitting portion cover 25 through a spring 63, which is formed of a shared resin, and a material 79 having a large Poisson's ratio. Thus, the shaped resin plate 27 is used in a living organism contact portion of the communication signal transmitting portion 59 so that a feeling of physical disorder can be prevented at a using time by an operator, and friction in a shearing direction can be reduced.

The magnetic circuit 35 has the yoke 29 of the cap shape, the permanent magnet 31 of a disk shape, and the supporting portion 33 for supporting the permanent magnet 31, and is integrally fixed in this order by the fixed portion 38 together with the spiral spring 37.

The voice input portion 61 is adjacent to the communication signal input portion 59 within the external cover 25, and has the microphone 43 stored into the vibrationproof material 41, the substrate 45 for supporting the microphone 43 on one face thereof, and the supporting member 69 for supporting the substrate 45. The members are stored into the external cover 15 through an elastic adhesive 49. A gap 71 is formed on a lower side of the external cover 15. The gap 71 is formed to avoid a mechanical interference of a change in living organism shape due to bending when the living organism conductive actuator is used by an operator's wrist, etc.

A main body of the living organism conductive actuator 57 is supported by two wires 13, 13. An outer circumferential portion of the wire 13 is guided by the viscoelastomer 65 so that the generation of an additional resonance is structurally restrained. The wires 13, 13 are supported by member 73, as shown in FIGS. 2A to 2D.

Figure 3A:
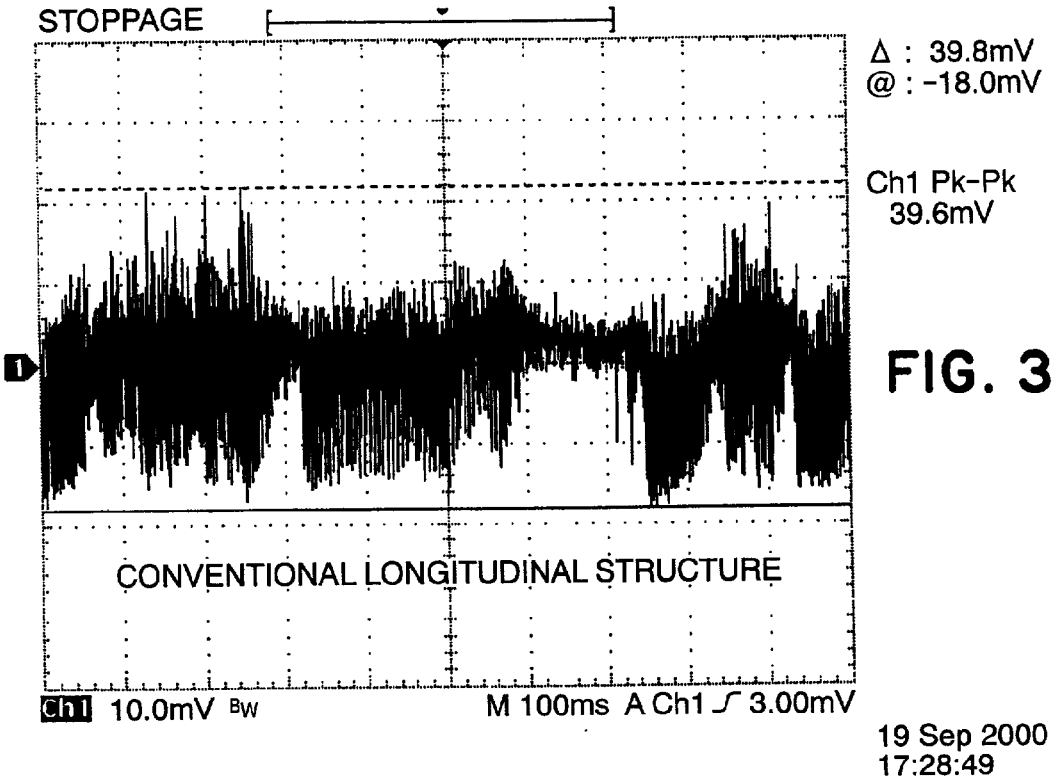
FIG. 3A is a graph showing a reduction in input noise due to the arrangement of a voice input portion of a conventional structure.
Figure 3B:
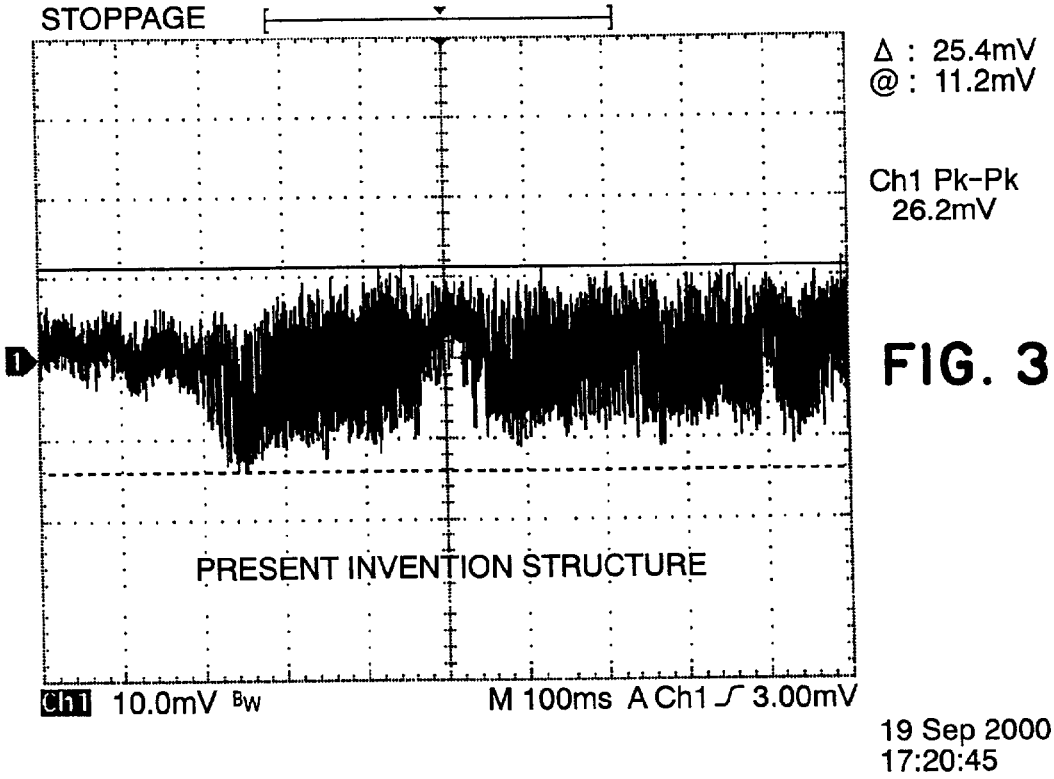
FIG. 3B is a graph showing a reduction in input noise due to the arrangement of a voice input portion of a structure of the invention.

As can be seen by comparing FIGS. 3A and 3B, a sound input noise can be reduced by moving an arrangement of the voice input portion 61 from an upper portion of the communication signal transmitting portion 59 to its side face portion in the structure of the invention. Further, the voice input noise transmitted via the external cover 15 is reduced by adding the microphone 43 in the voice input portion 61 and the vibrationproof material 41 around the substrate 45.

Figure 9:
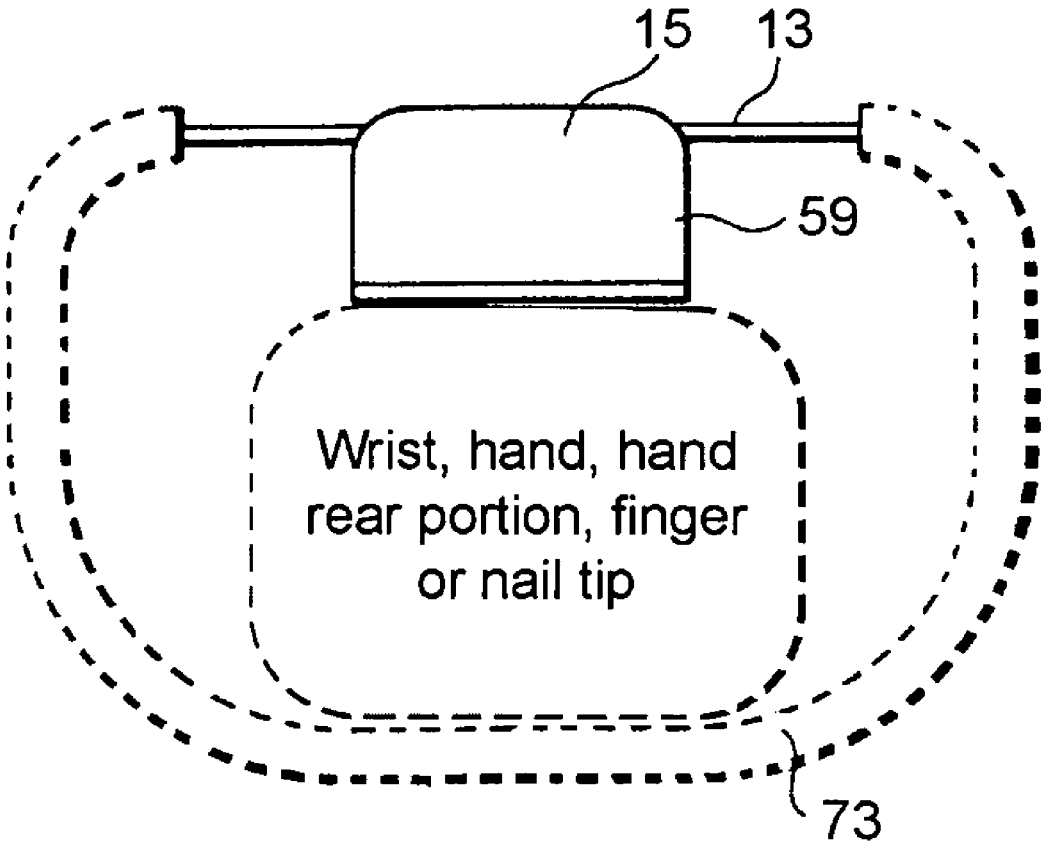
FIG. 9 is a cross-sectional view showing the communication signal transmitting portion of the living organism conductive actuator of the present invention connected to a wrist, hand, hand rear portion, finger, or nail tip of a user.

Vibration insulation and close contact with an living organism are improved by using the material 55 having a vibrationproof effect in a living organism contact portion except for the communication signal transmitting portion 59 such that no vibration transmitted to the living organism, e.g., an operator's wrist, hand, hand rear portion, finger, or nail tip, etc. (see FIG. 9), is returned to the external cover 15.

It is possible to restrain noises due to a mechanical load, such as manual, crushing with respect to the internal circuit 67 of the communication signal transmitting portion 59 by manufacturing the external cover 15 by a metal. In addition, it is possible to restrain damage due to the mechanical load, such as manual, crushing with respect to the internal circuit 67 by manufacturing the external cover 15 by a metal.

The weight of a main body of the living organism conductive actuator 57 is set to several ten grams and is about 2.5 times the conventional weight to reduce noise propagation (reduce sound leakage) due to a medium on an external surface so that loss due to the weight in kinetic energy is increased and a vibrational displacement on a side of the external cover 15 is reduced.

Figure 4:
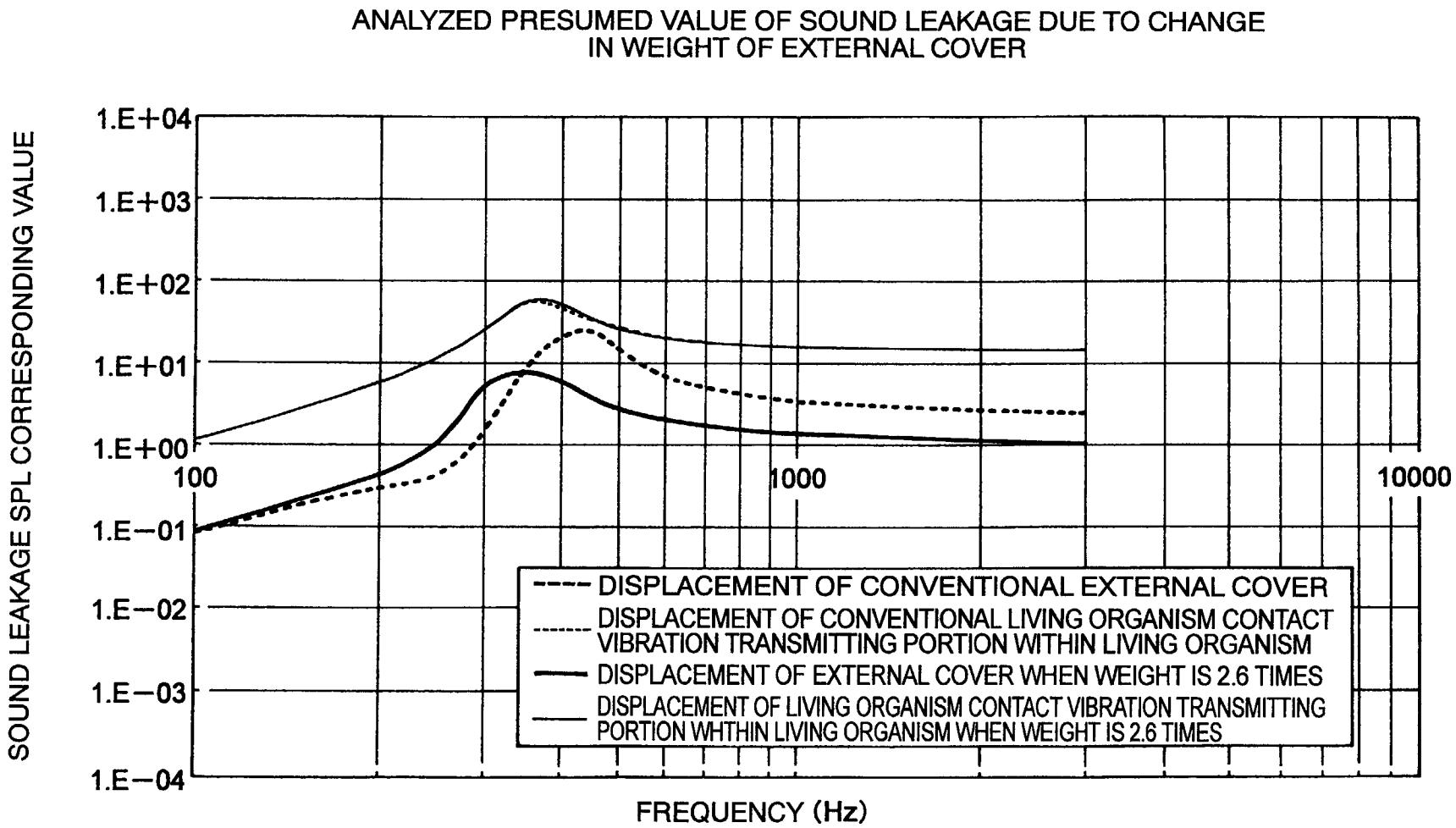
FIG. 4 is a graph showing an analyzed presumed value of sound leakage spl due to a change in weight of an external cover of the living organism conductive actuator in an embodiment of the invention.

As shown in FIG. 4, it is presumed by analysis that no displacement of the living organism contact vibration transmitting portion 21 at this time is changed in comparison with the displacement prior to a change in weight.

Figure 5:
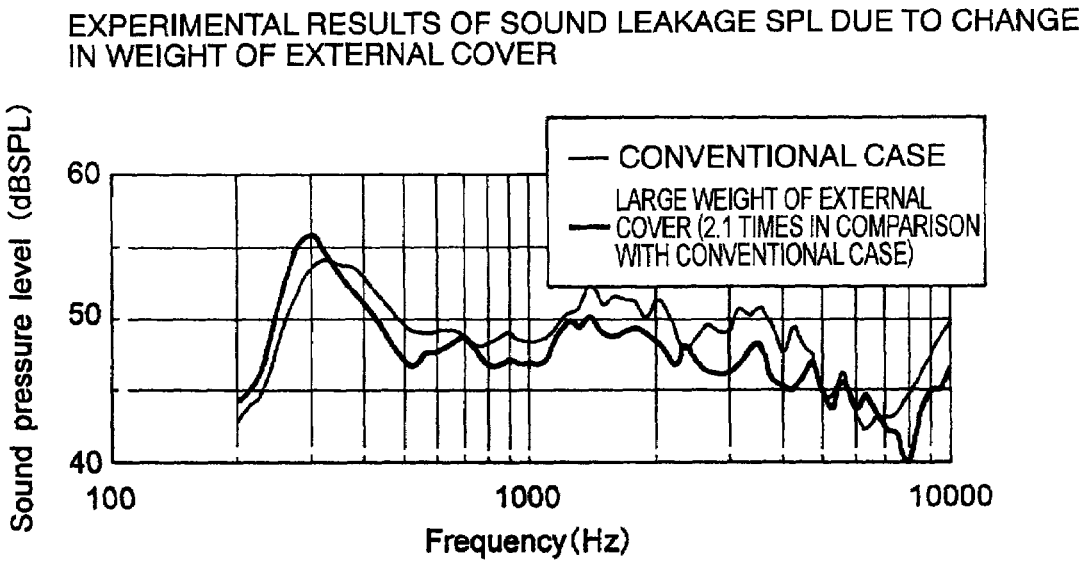
FIG. 5 is a graph showing experimental results of the sound leakage spl due to the change in weight of the external cover of the living organism conductive actuator in the embodiment of the invention.

As shown in FIG. 5, it should be understood that noise reducing effects are also clearly large in experimental results.

In the invention, a corner portion of the external cover 15 is chamfered and an effective area of vibration transmission is reduced as a reduction in structural sound leakage. Further, the sound leakage is reduced by setting a vibration system of the communication signal transmitting portion 59 to a two-resonance structure.

Figure 2A:
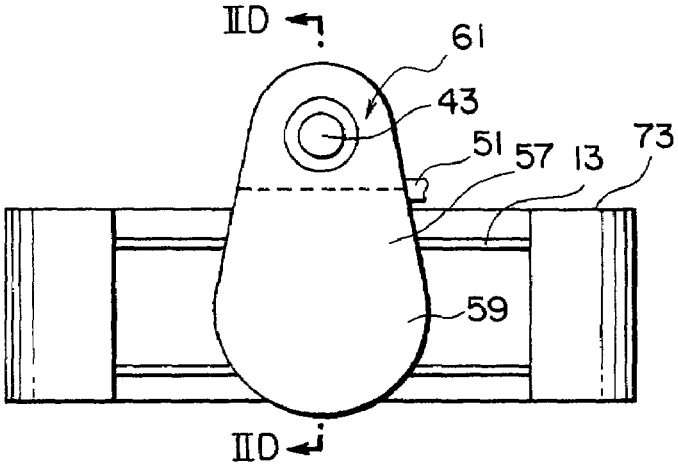
FIG. 2A is a plan view showing a living organism conductive actuator in an embodiment of the present invention.
Figure 2B:
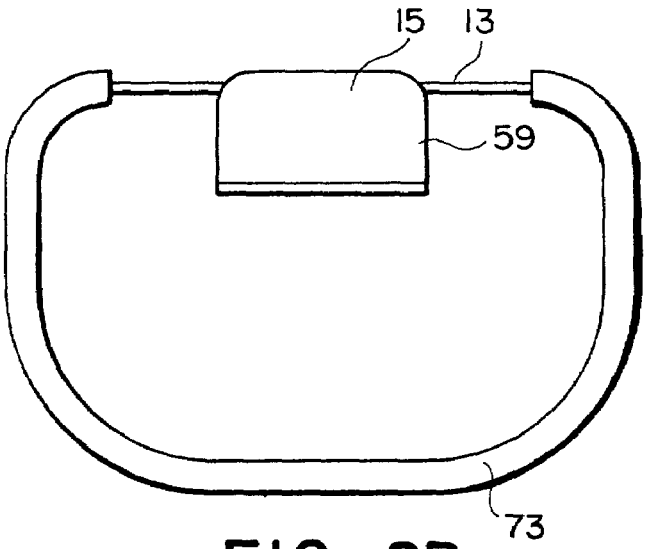
FIG. 2B is a front view of the actuator of FIG. 2A.
Figure 2D:
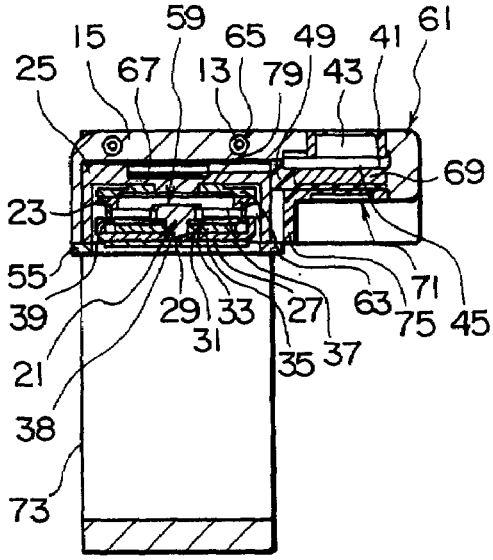
FIG. 2D is a cross-sectional view taken along line IID—IID of the actuator of FIG. 2A.
Figure 2C:
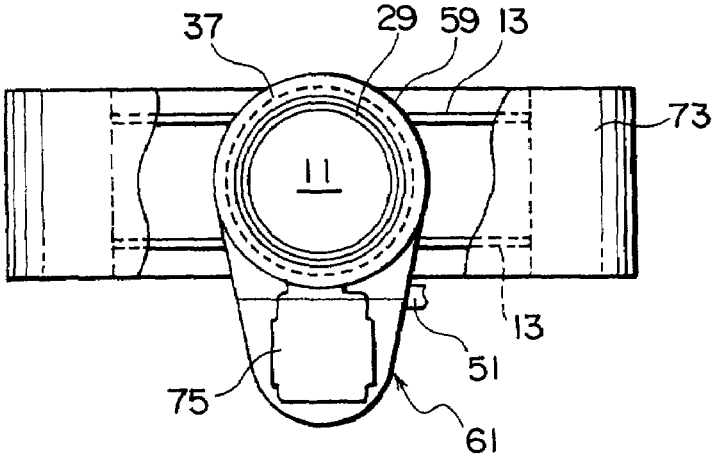
FIG. 2C is a bottom view of the actuator of FIG. 2A.

Concretely, with reference to FIG. 2D, a first vibration system is constructed by the spiral spring 37 and the magnetic circuit 35 as a mass. A second vibration system is constructed by the spring 63, which is formed of a shaped resin, the coil 39 and the base 23 as a mass.

In the first vibration system, a resonance frequency lies in the vicinity of 200 Hz. In the second vibration system, the resonance frequency is 10 kHz or more for reasons of cutoff on the high frequency area side of a received talk voice.

Figure 6:
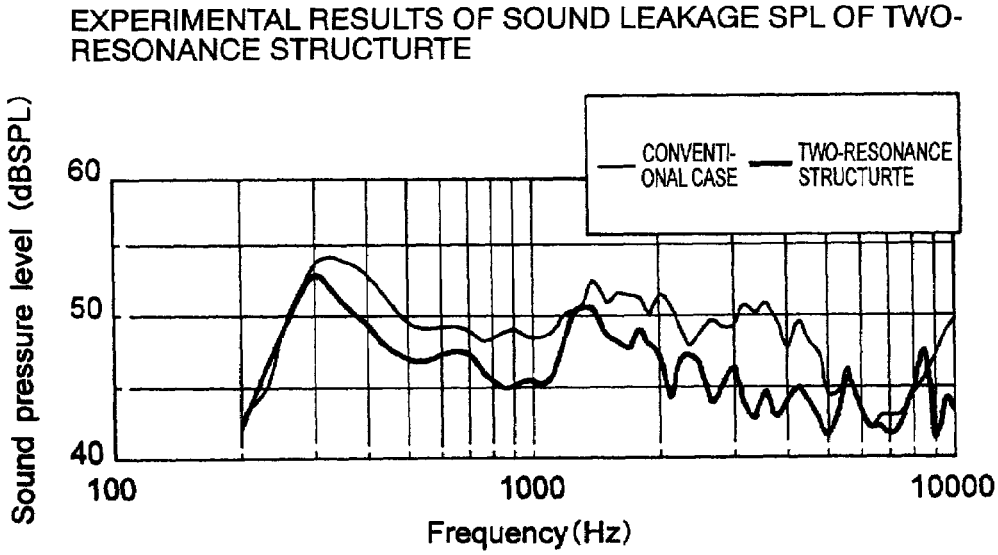
FIG. 6 is a graph showing experimental results of the sound leakage spl of a two-resonance structure.

As shown in FIG. 6, it should be understood that the sound leakage is reduced in a frequency area from 200 to 8000 Hz in the two-resonance structure of the invention.

Figure 7:
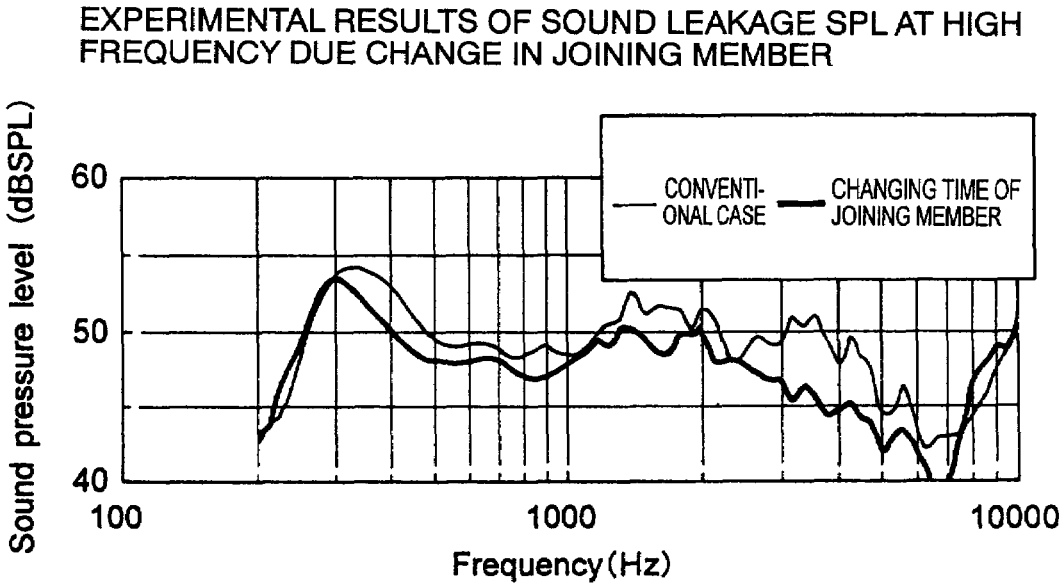
FIG. 7 is a graph showing experimental results of high frequency sound leakage spl due to a change in a joining member.
Figure 8A:
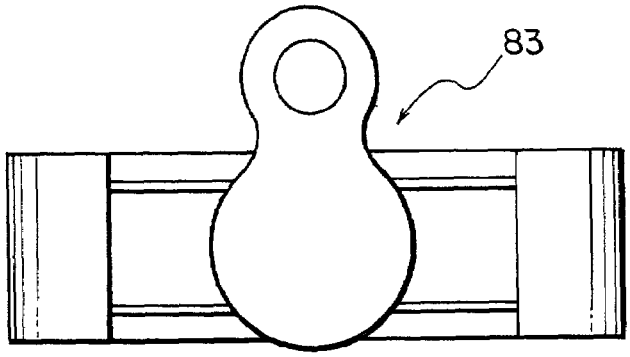
FIGS. 8A to 8D are views respectively showing various kinds of modified examples of the structure of the living organism conductive actuator in the embodiment of the invention.
Figure 8B:
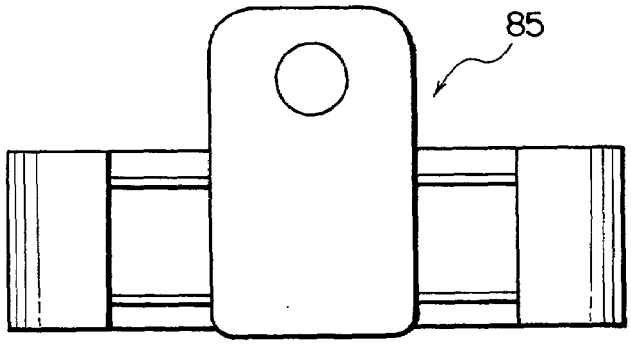
Figure 8C:
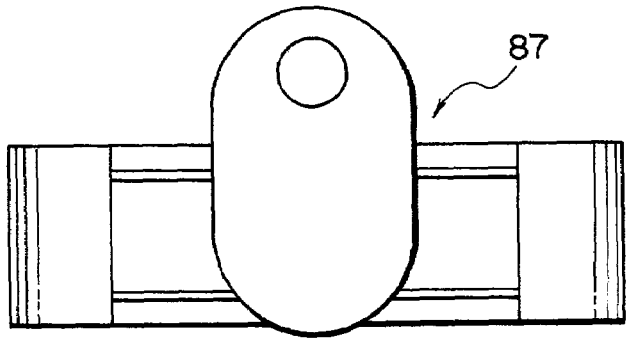
Figure 8D:
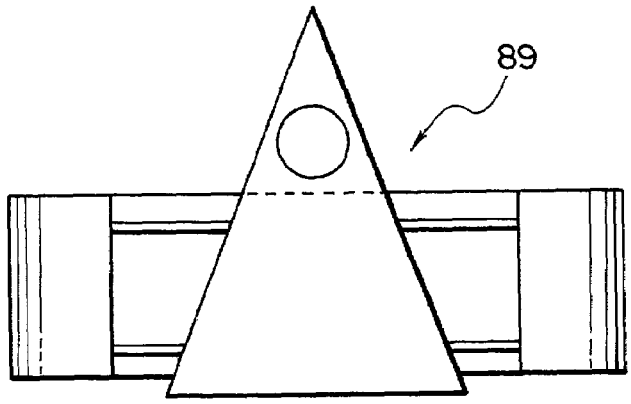

As shown in FIG. 7, a material 79 having a large Poisson's ratio (near 0.5), such as a double coated tape, is used in a joining portion of the first and second vibration systems, a joining portion of the second vibration system and the living organism contact vibration transmitting portion cover 25, or both these joining portions. Accordingly, vibrational energy in a vibration transmitting direction is dispersed in a vertical direction, and the vibrational energy in a second mode (z-directional resonance of an arm of the spiral spring) of the first vibration system can be relaxed so that it contributes to the reduction in sound leakage at high frequency.

Further, in the invention, the vibration systems are made by constructional parts, such as an upper portion of the communication signal transmitting portion, the substrate 45 and a wiring 51 in the vicinity of the voice input portion. Further, a structure for dispersing vibration directivity is adopted by using the elastic adhesive 49 in the joining portion so as not to generate additional vibration noises. Further, vibration transmission is improved as experimental results by using a structure in which a spring of the first vibration system of the communication signal transmitting portion 59 is set to a spiral body and a spiral arm is extended in a direction perpendicular to a face of the spiral body. The vibration theoretically enters the interior (an area having a shape close to a linear shape) from an unstable portion (an area extending in a nonlinear shape in time) of the external surface of a living organism by giving an initial load to the living organism.

In the embodiment of the invention mentioned above, the external cover is approximately formed in an egg shape. However, as shown in FIGS. 8A to 8D, effects similar to those in the embodiment of the invention are obtained even when the external cover is formed in a gourd shape 83, a square shape 85 having a round corner, an elliptical shape 87 and a triangular shape 89. Further, positions of the actuator and the wire may be located longitudinally and transversally. Further, similar to FIG. 2C, a circular hollow exposing the plate 27 of resin thereto, a metal case 75 corresponding to the microphone 43, and the gap 71 recessed by one stage from the cover are arranged on a bottom face side although these members are not shown in FIGS. 8A to 8D.

As explained above, in accordance with the invention, it is possible to construct an optimal structure able to reduce sound leakage and improve transmission characteristics and control a vibration transmitting path of internal and external portions in the living organism conductive actuator.

What is claimed is:

1. A living organism conductive actuator comprising:

a communication signal transmitting portion for transmitting a communication signal by vibration via one of a wrist, hand, hand rear portion, finger, and nail tip of a user, when the communication signal transmitting portion is in contact with said one of the wrist, hand, hand rear portion, finger, and nail tip of the user;

a voice input portion provided laterally adjacent to the communication signal transmitting portion; and two wires having a spring property and mounted on an external portion to support the living organism conductive actuator.

2. The living organism conductive actuator according to claim 1, further comprising a vibration-proof material on a living organism contact portion of the living organism conductive actuator, except for the communication signal transmitting portion.

3. A living organism conductive actuator comprising:

a communication signal transmitting portion for transmitting a communication signal by vibration via one of a wrist, hand, hand rear portion, finger, and nail tip of a user, when the communication signal transmitting portion is in contact with said one of the wrist, hand, hand rear portion, finger, and nail tip of the user;

a voice input portion provided laterally adjacent to the communication signal transmitting portion; and a vibration-proof material on a living organism contact portion of the living organism conductive actuator, except for the communication signal transmitting portion.

4. The living organism conductive actuator according to claim 3, further comprising:

an external portion;

two wires having a spring property and mounted on the external portion to support the living organism conductive actuator.

* * * * *